US006857948B2

(12) United States Patent
Bocka et al.

(10) Patent No.: US 6,857,948 B2
(45) Date of Patent: Feb. 22, 2005

(54) ABRASIVE STRIP CARRIER AND HAND SANDER

(75) Inventors: Sabine Bocka, Leinfelden-Echterdingen (DE); Marco Balmeli, Solothurn (CH)

(73) Assignee: Robert Bosch GmbH, Stuttgart (DE)

( * ) Notice: Subject to any disclaimer, the term of this patent is extended or adjusted under 35 U.S.C. 154(b) by 3 days.

(21) Appl. No.: 10/398,465

(22) PCT Filed: Jul. 27, 2002

(86) PCT No.: PCT/DE02/02778

§ 371 (c)(1),
(2), (4) Date: Apr. 3, 2003

(87) PCT Pub. No.: WO03/015987

PCT Pub. Date: Feb. 27, 2003

(65) Prior Publication Data

US 2004/0014410 A1 Jan. 22, 2004

(30) Foreign Application Priority Data

Aug. 10, 2001 (DE) ..... 101 39 547

(51) Int. Cl.[7] ..... B24B 23/00

(52) U.S. Cl. ..... 451/356; 451/344; 451/354; 451/514; 51/382

(58) Field of Search ..... 451/344, 354, 451/356, 499, 502, 514, 517, 519, 520, 523, 524; 51/382, 387, 170 R, 170 TL, 170 MT, 358

(56) References Cited

U.S. PATENT DOCUMENTS 3,349,523 A * 10/1967 Hutchins ..... 451/518
3,540,161 A * 11/1970 Daughetee et al. ..... 451/344
3,571,986 A * 3/1971 Champayne ..... 451/344
3,822,518 A * 7/1974 Sjostrand ..... 451/516
4,075,793 A * 2/1978 Vogel et al. ..... 451/356
4,077,165 A * 3/1978 Hutchins ..... 451/518
4,475,317 A * 10/1984 Dicke ..... 451/356
5,616,072 A * 4/1997 Walz et al. ..... 451/356
5,902,176 A * 5/1999 Chen ..... 451/524
6,447,382 B1 * 9/2002 Potempka ..... 451/332
6,626,746 B2 * 9/2003 Mayr et al. ..... 451/356

FOREIGN PATENT DOCUMENTS

DE 26 16 520 A 11/1977
GB 2 322 582 A 9/1998

* cited by examiner

*Primary Examiner*—Lee D. Wilson
*Assistant Examiner*—Anthony Ojini
(74) *Attorney, Agent, or Firm*—Michael J. Striker

(57) ABSTRACT

A power grinder, in particular an oscillating grinder (10), having a housing (12) and a grinding sheet holder (14), on whose working face (15) a grinding sheet (16) to be received is braced, and its reception is effected by means of clamping means (20, 23) that lock opposite grinding sheet ends (17, 19) to the grinding sheet holder (14), is made easier to operate, and its machining capacity is improved, by providing that for equipping it with the grinding sheet, the clamping means (20, 23) are movable jointly with a grinding sheet end (17) clamped to them away from the opposite, likewise clamped grinding sheet end (19), so that the latter is locked, while under tensile stress.

13 Claims, 4 Drawing Sheets

ABRASIVE STRIP CARRIER AND HAND SANDER

BACKGROUND OF THE INVENTION

The invention relates to a power grinder.

From British Patent GB 23 22 582, a pivotable pincer with a grinding plate for holding grinding sheets is known; the grinding sheet is braced with its back against the underside of the grinding plate and can be firmly clamped to its top.

For firmly clamping the grinding sheet, the user has to use both hands, and if at all possible the power tool should be placed on a firm support. One end of the grinding sheet has to be introduced with one hand into a slot between an opened clamping jaw and the top side of the grinding sheet holder, while the clamping jaw has to be kept open in the release position with the other hand until the grinding sheet end has been introduced. Once the clamping jaw is let go, it then closes by spring force and assumes its clamping position, in which it firmly clamps the end of the grinding sheet in a manner in which it is secured against being lost. The grinding sheet is automatically retightened to a certain degree in the process, in that the rotatably suspended clamping jaw rolls away from the end of the grinding sheet and carries it with it in the process—because of the skewed contact-pressure face on the top of the grinding sheet holder.

For clamping the other end of the grinding sheet, the above-described steps are to be repeated. The attainable clamping force and retightening force are relatively limited, so that a relative motion that occurs during operation of the grinding tool between the grinding sheet holder and the grinding sheet lessens the machining capacity in grinding and limits the service life of the grinding sheet.

SUMMARY OF THE INVENTION

The power grinder of the invention having the definitive characteristics of claim 1 has the advantage over the prior art that the grinding sheet, after being conveniently placed in the clamping device, can be tensed up to the tearing limit by the tensing motion thereof. As a result, the grinding sheet can be fixed so tautly between the two clamping points and on the working face of the grinding holder so that the relative motion between the grinding sheet holder and the grinding sheet is minimal. The result is greater abrasion performance and higher overall efficiency of the power grinder.

Because one of the clamping means is designed as a pincer and has clamping jaws, between which one end of the grinding sheet can be clamped, and the pincer together with the clamped end of the grinding sheet is movable about a pivot axis and can be arrested in an end position, convenient and effective clamping with subsequent taut tensing of the grinding sheet can be achieved by simple means.

The pincer has the advantage that grinding sheets of any thickness can be fastened with maximal clamping force, since a long closing path can compensate sensitively for all dimensional differences and assures a high clamping force that has previously never been achieved. Moreover, there is a high tolerance for different lengths of the grinding sheets, because there is space for them in the annularly designed active jaws, and protruding end of the grinding sheets can as a result be conveniently accommodated in the pincer.

Because one of the clamping jaws is designed as an active jaw and the other as a passive jaw, a powerful clamping-tensing device of simple construction is created.

Because spring means seek to keep the passive jaw open, and the active jaw carries the passive jaw along with it, counter to these spring means, into the clamping position and on into the tensing position, and the spring means determine the clamping force on the end of the grinding sheet, the power grinder can be equipped with grinding sheets easily and is easy to operate.

Because the active jaw is part of a two-armed tensing lever, whose one lever arm acts as a handle that can be locked releasably overlockingly in the tensing position, the clamping-tensing device is so simple in its design that known power grinders can be retrofitted with this novel kind of clamping-tensing device.

Because the pincer is pivotable about the pivot shaft between two end positions, which define its tensing and release positions, extremely simple operation of the clamping-tensing device is achieved.

Because in the tensing position of the pincer, the active jaw is braced with a minimum clamping force against the passive jaw, the clamping force on the end of the grinding sheet is definable, and the tautening of the grinding sheet up to the tearing limit can be defined.

Because the surfaces of the active and passive tensing jaws have great roughness, a high coefficient of friction, and a high stability against deformation, since they are of metal, an especially secure clamping action at the ends of the sandpaper is assured.

Because the active tensing jaw is curved on the order of a round hook and grips the passive tensing jaw in such a way that it is braced against the outside of the passive tensing jaw in order to clamp the grinding sheet and carries the passive tensing jaw along with it upon pivoting into the tensing position, a clamping-tensing mechanism that is especially easy to use is created.

Because elastic means keep the pincer open in the release position and in particular spread the active jaw apart relative to the passive jaw, it is possible to change the grinding sheet virtually blind.

Because the passive tensing jaw has a continuous longitudinal notch, the grip between the passive tensing jaw and the end of the sandpaper is improved, and the clamping force is reinforced.

BRIEF DESCRIPTION OF THE DRAWINGS

One exemplary embodiment of the invention is explained in further detail in the ensuing description in conjunction with an associated drawing. Shown are FIG. 1, a schematic side view of the kinematic principle of the clamping-tensing device of the power grinder of the invention.

DETAILED DESCRIPTION OF THE PREFERRED EMBODIMENTS

Figure 1:
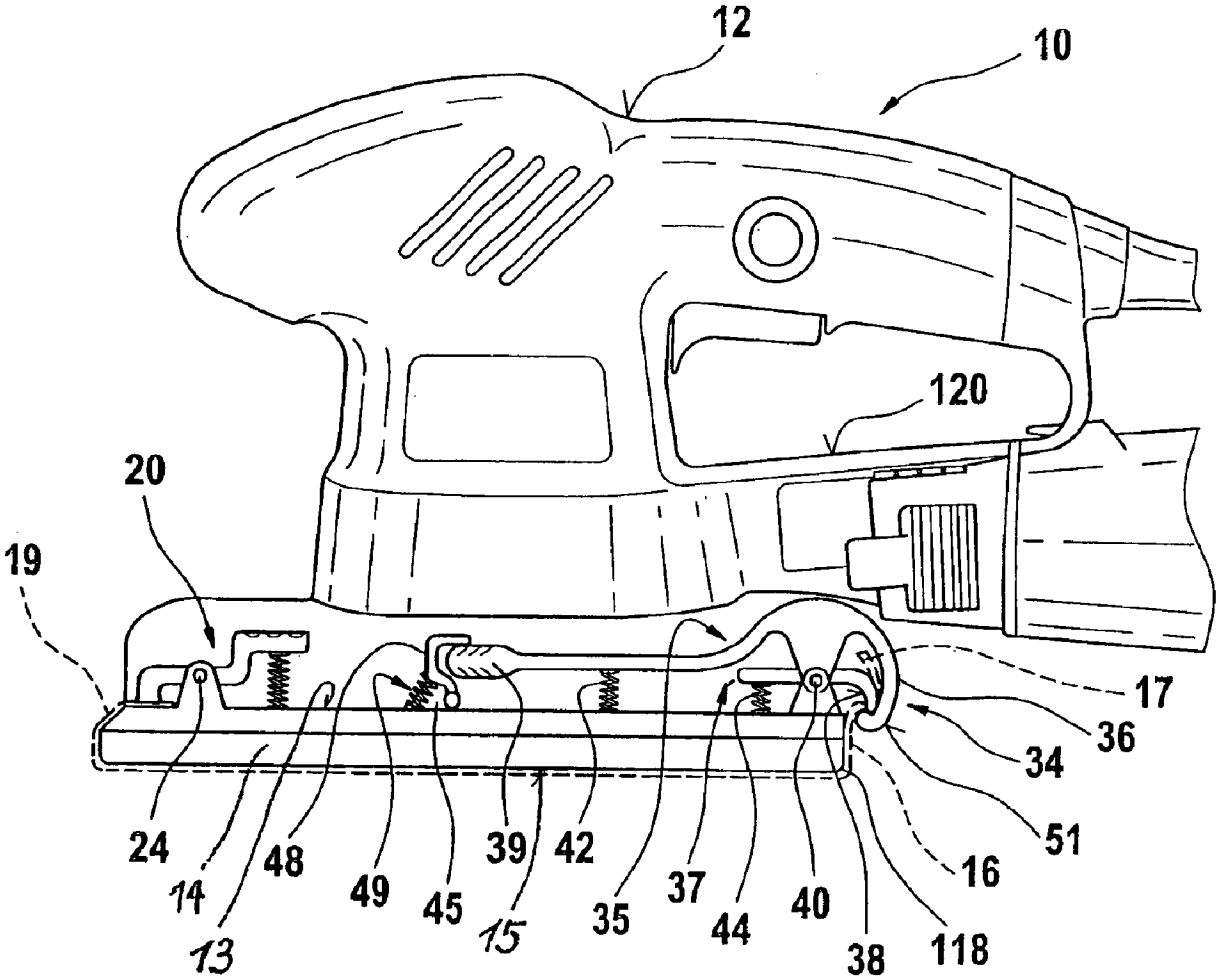

The power grinder 10 shown as an oscillating grinder in FIG. 1 has a housing 12 with a handle, not identified by reference numeral, and an electric motor disposed in it, as well as a grinding sheet holder 14 in the lower region, which driven by a motor can be set into oscillation relative to the housing 12, and as a result, with a grinding sheet 16 firmly held on its working face 15, grinding removal of material from a workpiece can be attained. The grinding dust produced in the process is blown out or extracted by suction at the rear through the aspiration, or extraction, stub 120.

The ends 17, 19 of the grinding sheet 16 are prestressed tautly and without slip relative to the working face 15 by clamping means 20 on the front on the top 13 of the grinding sheet holder 14 and by clamping-tensing means 34 at the back.

In the left in the direction viewed, the clamping means 20, in the form an angle bracket 20 that is rotatable about a pivot shaft 24, can be placed with spring prestressing against the end 19 of the grinding sheet and clamps it firmly against a detent face 23 on the top 13 of the grinding sheet holder 14.

On the right in the direction viewed, the clamping-tensing means 34 in the form of a pincer disposed on the grinding sheet holder 14 is disposed, with a tensing lever 35 with a curved active jaw 36 and with a handle 39; these form a two-armed lever that is pivotable about a pivot shaft 40. A clamping lever 37 that is braced on the inner contour of the active jaw 36 when the grinding sheet 16 is clamped and tensed can be seen; it is likewise pivotable about the pivot shaft 40 and it forms the passive jaw. Between the passive jaw 38 and the active jaw 36, the sandpaper end 17 is inserted and firmly held. Upon pivoting of the pincer 34 about the pivot shaft 40, the spacing between the opposite sandpaper ends 17, 19 increases. This is associated with pronounced tautening of the grinding sheet 16, which is thus pressed firmly against the working face 15 of the pad 18. How pronounced the tautening of the grinding sheet 16 is can be seen particularly from the deformation of the rear lower edge 118 of the pad 18 (FIG. 3) that is pressed into roundness.

In the tensing position of the pincer 34, the tensing lever 35 assumes an end position in which it is held by locking of the handle 39 in the detent groove 47 of the rear or lateral detent tab 48. By rotating the detent tab 48 back again counter to the spring 49, or by pivoting the handle 39 out of the detent groove 47, the tensing lever 35 is released and can be pivoted back into its open position with spring prestressing. The passive jaw 38 follows it—being acted upon by a further spring 44 (FIG. 4)—into its own end position. The tensing lever 35 rotates onward until its stop face 51 comes to rest on the inside of the passive jaw 38. In this position, the pincer 34 is wide open, and the spacing between the active and the passive jaws 36, 38 is so great that the sandpaper end 17, shown in dashed lines, can be inserted virtually blind.

The kinematic basic sketch of the pincer 34 shows the spring means 42, 44 especially clearly; they prestress the pincer 34 into the "open" position and furthermore determine the clamping force between the active jaw 36 and the passive jaw 38.

The opposite end 19 of the grinding sheet, when the tool is being equipped with a grinding sheet, should first be firmly clamped in the conventional tensing mechanism with the clamping means 20, in the form of a two-armed, spring prestressed lever, so that in the ensuing clamping-tensing step, the other end 17 of the grinding sheet can be moved with the pincer 34 and fixed.

The passive jaw 38 is kept prestressed by a compression spring 44, which determines the clamping force between the active jaw 36 and the passive jaw 38.

If for changing a grinding sheet the tensing lever 35 is released from its tensing position by unlocking of the tensing tab 48 and pivoted about the shaft 40, the spacing between the clamping points of the sandpaper ends 17, 19 becomes shorter again, so that the grinding sheet 16 relaxes and loosens and can then be easily removed.

Figure 2:
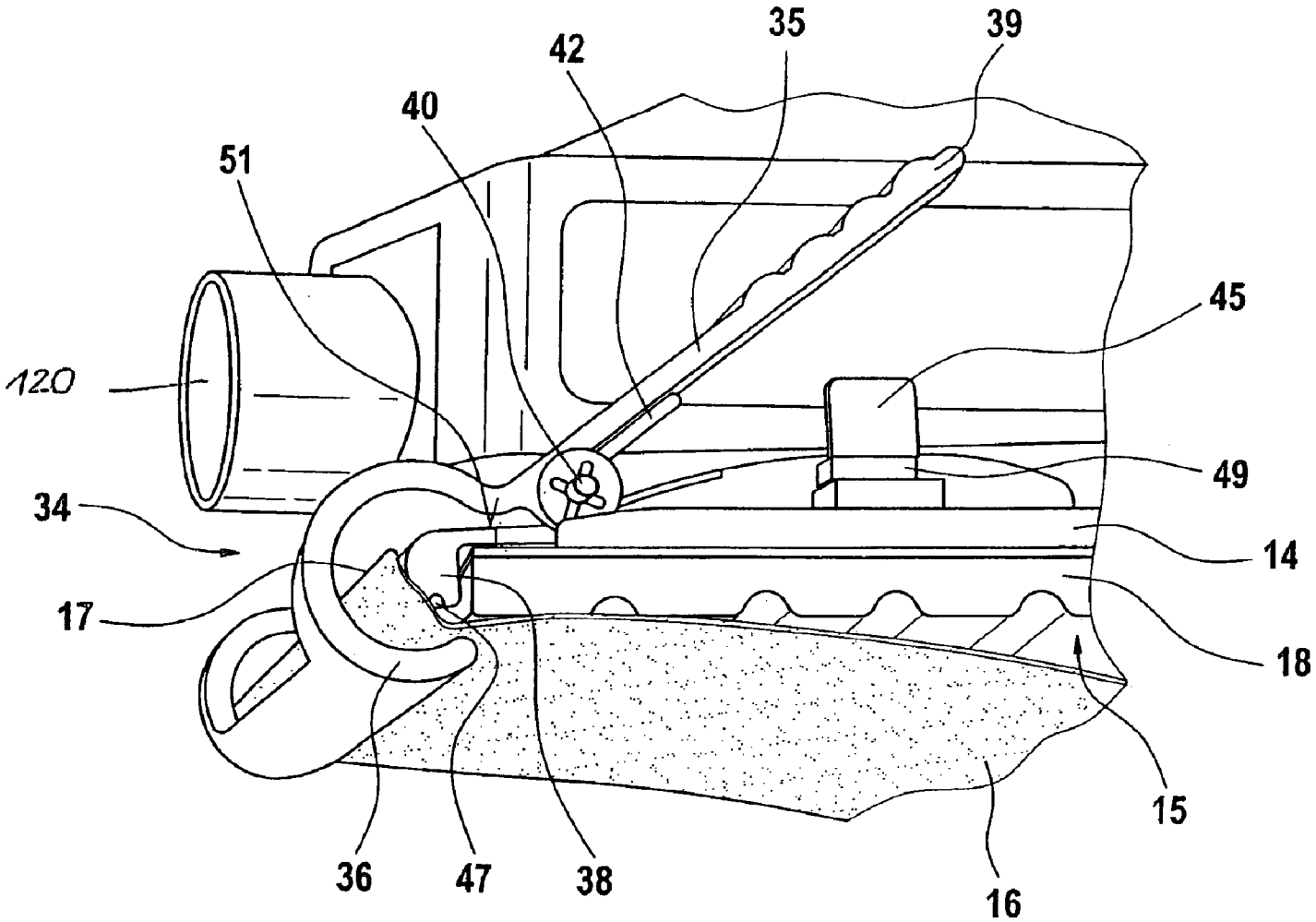
FIG. 2, a three-dimensional elevation view of the rear region of the power grinder with the clamping-tensing device as the grinding sheet is inserted.

FIG. 2 shows an enlarged view of another exemplary embodiment of the invention of the clamping-tensing device, disposed on the rear end of the housing 12 near the extraction stub 120; that is, it shows the pincer 34 when the sandpaper end 17 is being inserted. A leg spring 42 can also be seen, which prestresses the tensing lever 35 into the "open" position.

Another leg spring of this kind—not shown—is provided for prestressing the passive jaw 38; its force must be overcome upon closure of the pincer 34, if the passive jaw 38 is to be pivoted about the pivot shaft 40 into the tensing position. This clearly shows that the tensing force of the pincer 34 is determined by the dimensioning and prestressing of this spring.

Figure 3:
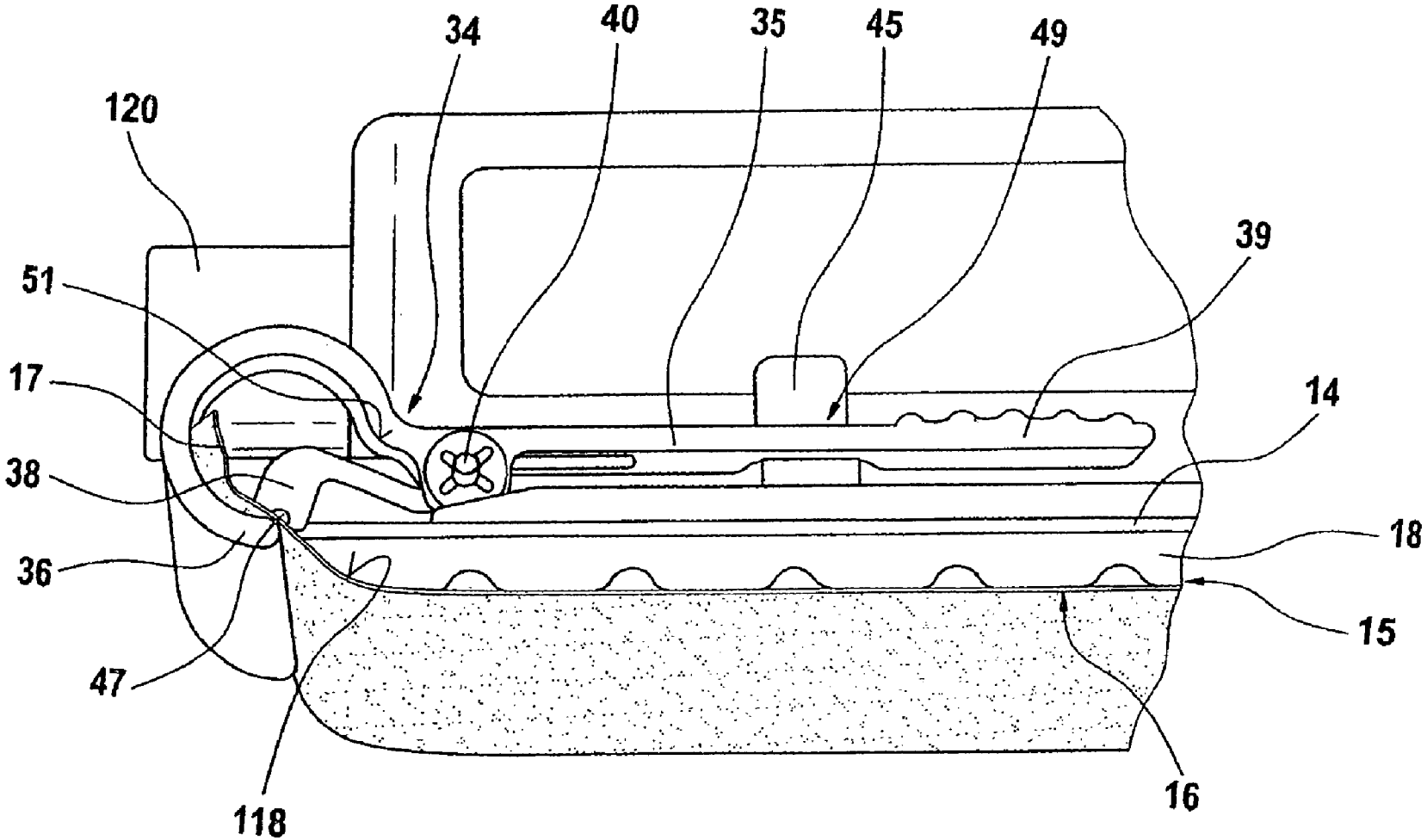
FIG. 3, the clamping-tensing device with the grinding sheet tensed.

FIG. 3 shows the pincer 34 in the tensing position; it is clearly apparent that the grinding sheet 16 rests so tautly on the left-hand edge, in the viewing direction, of the grinding pad 18, that the intrinsically angular grinding pad 18 at this point is rounded from compression.

Figure 4:
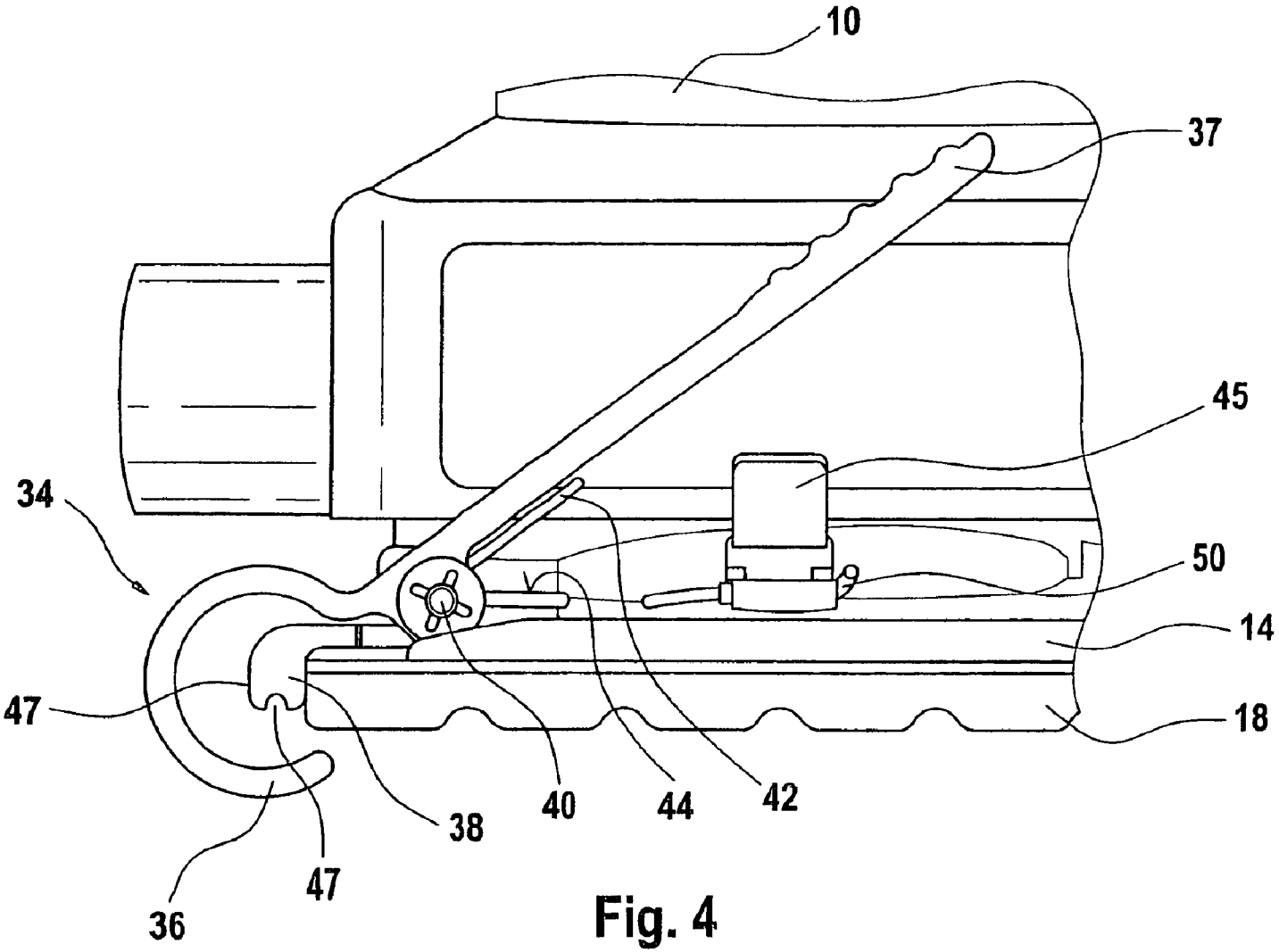
FIG. 4, a side view corresponding to FIG. 2, but without the grinding sheet.

FIG. 4 shows the side view of FIG. 3, in which some details described in conjunction with FIG. 1 become especially clear, especially the ejection spring 50, against which the handle 39 of the tensing lever 35 comes to rest in its tensing position. This spring, prestressed as the tensing lever 35 snaps into place in its tensing position, ejects the tensing lever upward by release from the tensing position and makes it easier to open the pincer 34. A clamping groove 47 can also be seen in the gripping region of the passive jaw 38; by means of it, the grinding sheet can be clamped especially firmly.

What is claimed is:

1. A power grinder in the form of an oscillating grinder (10), comprising a housing (12) and a grinding sheet holder (14) and having clamping means (20,23) far firmly holding opposed ends (17, 19) of a grinding sheet (16) that can be braced on a working face (15) of the grinding sheet holder (16), wherein the clamping means (20, 23) rotates about a defined axis together with the grinding sheet in a rotational movement, wherein the grinding sheet is fixedly held between the clamping means, so that the grinding sheet must follow the rotational movement of the clamping means.

2. The power grinder of claim 1, wherein one of the clamping means (20, 23) is designed as a pincer (34) and has clamping jaws (36, 38), between which a grinding sheet end (17, 19) can be clamped, and that the pincer (34) is movable about a pivot shaft (40) with the clamping jaws (36, 38) and jointly with the clamped grinding sheet end (36, 38) and is releasably lockable in an outward-pivoted position.

3. The power grinder of claim 2, wherein one of the clamping jaws (36, 38) is designed as a manually actuatable active tensing jaw (36), and the other is designed as a passive tensing jaw (38) that can be actuated indirectly via the active tensing jaw (36).

4. The power grinder of claim 3, wherein spring means (42, 44) tend to keep the passive tensing jaw (38) and the active tensing jaw (36) in their "open" position.

5. The power grinder of claim 4, wherein the active tensing jaw (36) upon closing is braced counter to the prestressing direction of the spring means (42, 44) against the passive tensing jaw (38) disposed as a resilient stop and carries the passive jaw with it into the tensing position by pivoting it, and the maximum clamping force is applied to the grinding sheet end (17, 19) in the tensing position.

6. The power grinder of claim 5, wherein the pincer (34) is pivotable about the pivot shaft (40) between two end positions, which define tensing and release positions of the pincer.

7. The power grinder of claim 6, wherein the surfaces of the active and passive tensing jaws (36, 38) have a high roughness and comprise metal.

8. The power grinder of claim 7, wherein the active tensing jaw (36) grips the passive tensing jaw (38), and an end of the passive tensing jaw is braced in the manner of a stop on the inside of the active tensing jaw (36) to clamp the grinding sheet (16) and upon pivoting can be carried along into the tensing position.

9. The power grinder of claim 4, wherein the active tensing jaw (36) acts as part of a two-armed tensing lever (35), one lever arm of which serves as a handle (39), which is releasably lockable overlockingly in the tensing position of the pincer (34).

10. A power grinder in the form of an oscillating grinder (10), comprising:

a housing (12);

a grinding sheet holder (14); and clamping means (20, 23) for firmly holding opposed ends (17, 19) of a grinding sheet (16) that can be braced on a working face (15) of the grinding sheet holder (16), wherein the clamping means (20, 23) are movable jointly, with a grinding sheet end (17) clamped to them, away from the other, likewise clamped grinding sheet end (19), so that the grinding sheet (16) can be locked with tensile stress up to the tearing limit;

wherein one of the clamping means (20, 23) is designed as a pincer (34) and has clamping jaws (36, 38), between which a grinding sheet end (17,19) can be clamped, and that the pincer (34) is movable about a pivot shaft (40) with the clamping jaws (36, 38) and jointly with the clamped grinding sheet end (36, 38) and is releasably lockable in an outward-pivoted position;

wherein one of the clamping jaws (36, 38) is designed as a manually actuatable active tensing jaw (36), and the other is designed as a passive tensing jaw (38) that can be actuated indirectly via the active tensing law (36);

wherein spring means (42, 44) tend to keep the passive tensing jaw (38) and the active tensing jaw (38) in their "open" position; and wherein the active tensing jaw (36) upon closing is braced counter to the prestressing direction of the spring means (42, 44) against the passive tensing jaw (38) disposed as a resilient stop and carries the passive jaw with it into the tensing position, thereby pivoting it, and the maximum clamping force is applied to the grinding sheet end (17, 19) in the tensing position.

11. A power grinder in the form of an oscillating grinder (10), comprising:

a housing (12);

a grinding sheet holder (14); and clamping means (20, 23) for firmly holding opposed ends (17, 19) of a grinding sheet (16) that can be braced on a working face (15) of the grinding sheet holder (16), wherein the clamping means (20, 23) are movable jointly, with a grinding sheet end (17) clamped to them, away from the other, likewise clamped grinding sheet end (19), so that the grinding sheet (16) can be locked with tensile stress up to the tearing limit;

wherein one of the clamping means (20, 23) is designed as a pincer (34) and has clamping jaws (36, 38), between which a grinding sheet end (17, 19) can be clamped, and that the pincer (34) is movable about a pivot shaft (40) with the clamping jaws (36; 38) and jointly with the clamped grinding sheet end (36, 38) and is releasably lockable in an outward-pivoted position;

wherein one of the clamping jaws (36, 38) is designed as a manually actuatable active tensing jaw (36), and the other is designed as a passive tensing jaw (38) that can be actuated indirectly via the active tensing jaw (36);

wherein spring means (42, 44) tend to keep the passive tensing jaw (38) and the active tensing jaw (36) in their "open" position;

wherein the active tensing jaw (36) upon closing is braced counter to the prestressing direction of the spring means (42, 44) against the passive tensing jaw (38) disposed as a resilient stop and carries the passive with it into the tensing position, thereby pivoting it, and the maximum clamping force is applied to the grinding sheet end (17, 19) in the tensing position; and wherein the pincer (34) is pivotable about the pivot shaft (40) between two end positions, which define tensing and release positions of the pincer.

12. A power grinder in the form of an oscillating grinder (10), comprising:

a housing (12);

a grinding sheet holder (14); and clamping means (20, 23) for firmly holding opposed ends (17, 19) of a grinding sheet (16) that can be braced on a working face (15) of the grinding sheet holder (16), wherein the clamping means (20, 23) are movable jointly, with a grinding sheet end (17) clamped to them, away from the other, likewise clamped grinding sheet end (19), so that the grinding sheet (16) can be locked with tensile stress up to the tearing limit;

wherein one of the clamping means (20, 23) is designed as a pincer (34) and has clamping jaws (36, 38), between which a grinding sheet end (17, 19) can be clamped, and that the pincer (34) is movable about a pivot shaft (40) with the clamping jaws (36, 38) and jointly with the clamped grinding sheet end (38, 38) and is releasably lockable in an outward-pivoted position;

wherein one of the clamping jaws (36, 38) is designed as a manually actuatable active tensing jaw (38), and the other is designed as a passive tensing jaw (38) that can be actuated indirectly via the active tensing jaw (36);

wherein spring means (42, 44) tend to keep the passive tensing jaw (38) and the active tensing jaw (36) in their "open" position;

wherein the active tensing jaw (36) upon closing is braced counter to the prestressing direction of the spring means (42, 44) against the passive tensing jaw (38) disposed as a resilient stop and carries the passive with it into the tensing position, thereby pivoting it, and the maximum clamping force is applied to the grinding sheet end (17, 19) in the tensing position;

wherein the pincer (34) is pivotable about the pivot shaft (40) between two end positions, which define tensing and release positions of the pincer; and wherein the surfaces of the active and passive tensing jaws (36, 38) have a high roughness and comprise metal.

13. A power grinder in the form of an oscillating grinder (10), comprising:

a housing (12);

a grinding sheet holder (14); and clamping means (20, 23) for firmly holding opposed ends (17, 19) of a grinding sheet (16) that can be braced on a working face (15) of the grinding sheet holder (16), wherein the clamping means (20, 23) are movable jointly, with a grinding sheet end (17) clamped to them, sway from the other, likewise clamped grinding sheet end (19), so that the grinding sheet (16) can be locked with tensile stress up to the tearing limit;

wherein one of the clamping means (20, 23) is designed as a pincer (34) and has clamping jaws (36, 38), between which a grinding sheet end (17, 19) can be clamped, and that the pincer (34) is movable about a pivot shaft (40) with the damping jaws (36, 38) and jointly with the clamped grinding sheet end (36, 38) and is releasably lockable in an outward-pivoted position;

wherein one of the clamping jaws (36, 36) is designed as a manually actuatable active tensing jaw (36), and the other is designed as a passive tensing jaw (38) that can be actuated indirectly via the active tensing law (36);

wherein spring means (42, 44) tend to keep the passive tensing jaw (38) and the active tensing jaw (36) in their "open" position;

wherein the active tensing jaw (36) upon closing is braced counter to the prestressing direction of the spring means (42, 44) against the passive tensing jaw (38) disposed as a resilient stop and carries the passive with it into the tensing position, thereby pivoting it, and the maximum clamping force is applied to the grinding sheet end (17, 19) in the tensing position;

wherein the pincer (34) is pivotable about the pivot shaft (40) between two end positions, which define tensing and release positions of the pincer;

wherein the surfaces of the active and passive tensing jaws (36, 38) have a high roughness and comprise metal, and wherein the active tensing jaw (36) grips the passive tensing jaw (38), and an end of the passive tensing jaw is braced in the manner of a stop on the inside of the active tensing jaw (36) to clamp the grinding sheet (16) and upon pivoting can be carried along into the tensing position.

* * * * *